US006123063A

United States Patent [19]

Boerjes

[11] Patent Number: 6,123,063

[45] Date of Patent: Sep. 26, 2000

[54] STACKER IGNITION SYSTEM

[75] Inventor: Herbert Boerjes, El Paso, Tex.

[73] Assignee: Autotronic Controls Corporation, El Paso, Tex.

[21] Appl. No.: 09/301,936

[22] Filed: Apr. 29, 1999

[51] Int. Cl.[7] ..... F02P 3/08; F02P 15/00

[52] U.S. Cl. ..... 123/598; 123/620; 123/640

[58] Field of Search ..... 123/598, 605, 123/620, 640

[56] References Cited

U.S. PATENT DOCUMENTS

| | | | |
|---|---|---|---|
| 3,280,809 | 10/1966 | Issler | 123/598 |
| 3,919,993 | 11/1975 | Neuman | 123/620 |
| 4,324,216 | 4/1982 | Johnson et al. | 123/406.13 |
| 4,393,850 | 7/1983 | Nishida et al. | 123/620 X |
| 4,538,573 | 9/1985 | Merrick | 123/406.5 |
| 4,619,241 | 10/1986 | Yoshinari | 123/620 |
| 4,883,033 | 11/1989 | Hosoe et al. | 123/335 |
| 4,892,080 | 1/1990 | Morino et al. | 123/605 X |
| 5,509,389 | 4/1996 | Oshima et al. | 123/406.5 |
| 5,526,785 | 6/1996 | Masters | 123/335 |

FOREIGN PATENT DOCUMENTS

| | | | |
|---|---|---|---|
| 59-165869 | 9/1984 | Japan | 123/620 |

*Primary Examiner*—Tony M. Argenbright
*Attorney, Agent, or Firm*—Fitch, Even, Tabin & Flannery

[57] ABSTRACT

Ignition system componentry which may be coupled or stacked with a conventional high energy ignition system with an ignition storage capacitor coupled to the ignition coil including an electronic controller provided as responsive to the current flow through a transmission ignition coil. A discharge switch is connected in a circuity for discharging the storage capacitor into the ignition coil, the discharge switch being coupled to the electronic controller for controlling the charging and the discharging of the storage capacitor in cooperation with the conventional HEI ignition system using the interruption of the current to the ignition transformer in the conventional system for generating a trigger signal for the capacitive discharge assembly in cooperation with the HEI system upon which it is stacked for generating high energy spark producing potentials optimized for the internal combustion engine.

17 Claims, 20 Drawing Sheets

10
12 V POWER (IGNITION SWITCH)

CONTROLLER
RELUCTANCE TIMING PICKUP
INPUT SIGNAL COND.
DWELL COMPUT.
CURRENT SENSOR
I-SENSE
GROUND
40
100K
100K
100K
+5V
2N2907
10K
30
.01UF
1N4148
10K
10K
1N5231
10K
10K
100K
2N2222
2N2222
10K

12 V POWER (IGNITION SWITCH)
10

RELUCTANCE TIMING PICKUP
CONTROLLER
INPUT SIGNAL COND.
DWELL COMPUT.
CURRENT SENSOR
I-SENSE
GROUND
40
100K
100K
100K
+5V
2N2907
10K
2.2UF
470Ω
1N5231
0.1UF
1N4148
QUICK SHOT
10K
1N5231
10K
10K
10K
100K
2N2222
2N2222
10K
10K
20 DEG.
MULTI SPARK SIGNAL
1N4004
10Ω
V+
4.7UF
TPS2813
12V
INV
4.7UF
GROUND
CONVERTER TO CHARGE STORAGE CAPACITOR

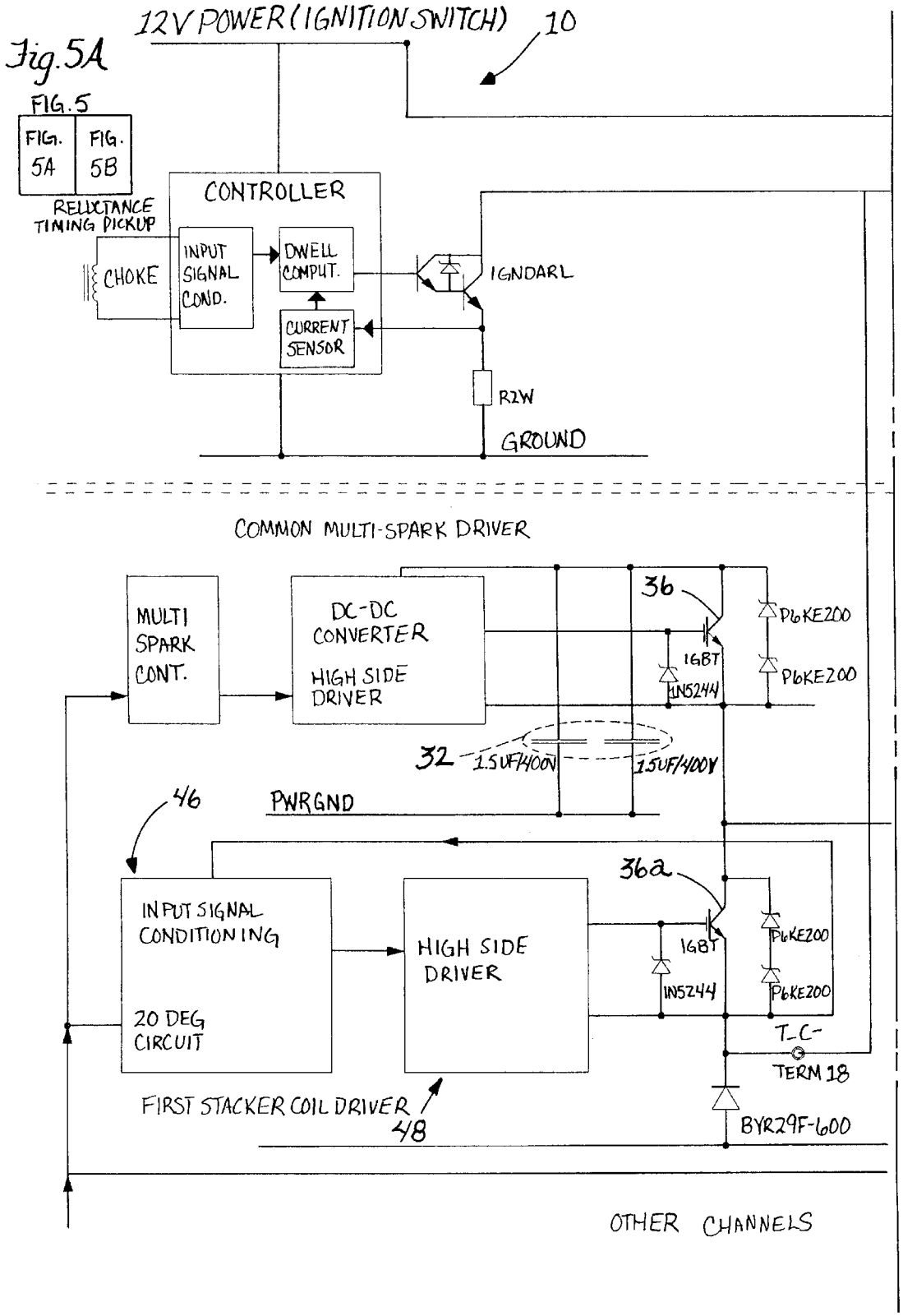
Fig. 5A
12V POWER (IGNITION SWITCH)
10
FIG. 5
FIG. 5A
FIG. 5B
RELUCTANCE TIMING PICKUP
CHOKE
CONTROLLER
INPUT SIGNAL COND.
DWELL COMPUT.
CURRENT SENSOR
IGNDARL
R2W
GROUND
COMMON MULTI-SPARK DRIVER
MULTI SPARK CONT.
DC-DC CONVERTER
HIGH SIDE DRIVER
36
IGBT
1N5244
P6KE200
P6KE200
32
1.5UF/400V
1.5UF/400V
PWRGND
46
INPUT SIGNAL CONDITIONING
20 DEG CIRCUIT
HIGH SIDE DRIVER
36a
IGBT
1N5244
P6KE200
P6KE200
T_C-
TERM 18
BYR29F-600
FIRST STACKER COIL DRIVER
48
OTHER CHANNELS 12V POWER (IGNITION SWITCH)
10
CONTROLLER
RELUCTANCE TIMING PICKUP
CHOKE
INPUT SIGNAL COND.
DWELL COMP.
CURRENT SENSOR
IGNDARL
R2W
GROUND
30
12V POWER (IGNITION SWITCH)
12V POWER (BATTERY)
CD-IGNITION CONTROLLER
POWER DC/DC CONVERTER
GP15K
FAST RESET DIODE
1.5U/400V
COIL VOLTAGE TRIGGER
TERM 18
INPUT SIGNAL COND.
SCR CONTROLLER
32
SLOW RESET DIODE
SCR
GROUND

| FIG. 7A | FIG. 7B |
|---|---|

STACKER IGNITION SYSTEM

BACKGROUND OF THE INVENTION

1. Field of the Invention

This invention relates to spark generation and timing apparatus for internal combustion engines and particularly to a stacked capacitive discharge ignition apparatus for use with a conventional high energy ignition (HEI) of an internal combustion engine having an ignition transformer connected in a circuit for discharging an ignition storage capacitor into the transformer.

2. Background and Description of Related Art

Commercial engines for vehicles are typically provided with a modern version of a conventional Kettering ignition in which an electronic controller is connected in circuit with an ignition transformer for providing a current through a primary coil for generating an ignition voltage across a secondary coil of the ignition transformer to provide a high energy spark producing potential. The conventional High Energy Ignition (HEI) as presently employed in many vehicles is shown in FIG. 1A in which an electronic controller receives a magnetic reluctance timing pickup signal relating to the rotation of the engine crankshaft for switching a Darlington-pair current switch (Q1) which is used to initiate current through the primary coil of an ignition transformer for storing energy in the primary coil. Previously, ignitions have used mechanical switch contacts, known as points, as the current switch for completing the current path between the power source, through the primary coil to electrical ground. As shown, a current sensing resistor may be provided in the circuit path for allowing the electronic controller to sense and control the current flowing through the primary coil of the ignition transformer. Accordingly, in an HEI system, when the current switch is closed, current starts flowing through the primary coil which sets up a magnetic field for storing energy in the ignition coil as the magnetic field is built up.

When the current through the ignition coil in an HEI ignition is interrupted, the energy stored in the magnetic field of the primary is then released through the secondary winding of the ignition transformer for generating a high energy spark producing potential. The turns ratio of the primary and secondary coil of the ignition transfer is typically a step up on the order of 100:1, which provides the high output voltage required at the spark gap of the spark plug connected through a distributor to the secondary winding coil of the ignition transformer. Thus, as the current switch opens, the magnetic field collapses and drives a high voltage current directed through the use of a high voltage distributor to the spark plugs of the internal combustion engine. The buildup and collapse of the magnetic field in the ignition transformer, however, is somewhat sluggish, providing the high energy over a relatively long ignition period, e.g., 1 to 3 milliseconds, which are not suitable for high engine revolutions per minute (rpms). Thus, the HEI system is not particularly effective at high rpms, whereas the CD system is relatively better suited for high rpm operation because of its high current and power in a short duration operation.

An alternate Capacitive Discharge (CD) ignition is known for providing very high power over relatively short duration ignition discharge periods, e.g., approximately 300 microseconds, through the use of discharging a high voltage capacitance through the ignition transformer. The CD ignition employs an ignition storage capacitor which is charged to several hundred volts, upon which a discharge switch is used under control of a timing controller for discharging the storage capacitor into the ignition transformer. With the capacitance and the leakage inductance of the ignition transformer forming a resonant circuit, the current delivered to the ignition transformer rises in a quarter of the resonance period to a maximum value of approximately 10 to 40 amperes, i.e., 100 to 400 milliamps at the secondary coil with a 100:1 turns ratio. Once the storage capacitor is fully discharged, building energy in the leakage inductance of the ignition transformer, the current in the leakage inductance represents a transfer of energy from the storage capacitor which is then stored in the magnetic field of the leakage inductance which is transferred to the secondary coil of the ignition transformer to provide the spark producing potential at the output of the transformer.

In the CD ignition, the primary inductance of the primary coil of the ignition transformer, however, represents a parasitic stored energy in the primary inductance which takes a relatively long time to decay. This current decays very slowly because of the low impedance and high inductance involved. Where the CD ignition is used at a high repetition rate (high rpms), the potential would exist for a direct current (DC) buildup in the ignition transformer which subtracts from the current provided at the output of the ignition transformer. Accordingly, an alternative path is provided with a diode, allowing the energy built up in the parasitic primary inductance to be reset quickly, however, the parasitic stored energy represents wasted energy nonetheless.

In the HEI ignition, on the other hand, the beneficial portion of the stored energy is provided from the primary inductance of the ignition transformer. With the HEI ignition, energy stored in the leakage inductance provides little benefit, and thus as illustrated in FIG. 1B is dissipated across the current switch of the HEI ignition already discussed. In the CD ignition, however, the beneficial portion of the stored energy is stored in the leakage inductance of the ignition coil. Thus as illustrated in FIG. 1C, the energy stored in the primary inductance acts as the parasitic inductance which provides little benefit, and is dissipated using a path provided across the primary inductance of the ignition transformer. It would be desirable therefore to provide an efficient ignition system taking advantage of the benefits of both the HEI and CD ignitions, while avoiding the respective circuit factors leading to parasitic components which generate potential stored energy losses.

SUMMARY OF THE INVENTION

An ignition system in accordance with the present invention provides an approach for stacking certain components of a HEI ignition with those of the CD ignition systems which may employ a single ignition coil for exploiting the best characteristics of both the HEI and CD ignition systems, while taking advantage of or avoiding the detrimental effects of stored energies associated with parasitic inductive components of ignition transformers. Thus, the stacked ignition system may be embodied to provide a capacitive discharge ignition apparatus for use with a conventional ignition of an internal combustion engine having an ignition transformer connected in a circuit for providing a current to the ignition transformer as a hybridization of conventional and capacitive discharge characteristics in a single ignition system, referred to herein as the stacker ignition system.

Briefly summarized, the invention relates to methods and apparatus for use with internal combustion ignition systems in which a first controller provides a timing pickup input responsive to the crankshaft position of the internal combustion engine. An ignition coil is provided in circuit with a current switch for providing a current flow through the ignition coil, the current switch being coupled to the first controller for controlling the current flow with respect to the crankshaft position. An ignition storage capacitor is then coupled to the ignition coil and a second controller is provided as responsive to the current flow through the ignition coil. A discharge switch is connected in a circuit for discharging the storage capacitor into the ignition coil, the discharge switch being coupled to the second controller for controlling the charging and the discharging of the storage capacitor in cooperation with the conventional ignition using the current switch for interruption of the current to the ignition transformer for generating high energy spark producing potentials being optimized for the spark plugs of the internal combustion engine.

The electronic ignition systems and methods described herein provide additional features which are not provided by conventional ignition circuits. One such improvement includes the capacitive discharge ignition apparatus for use with a conventional ignition, which may be referred to as a stacker ignition. Also provided is the generation of high energy spark producing potentials having duration and energy levels which are delivered to provide optimized performance of the internal combustion engine. Other features and advantages of the stacker ignition system will be apparent from the drawings and detailed description.

BRIEF DESCRIPTION OF THE DRAWINGS

FIG. 1A illustrates a conventional prior art High Energy Ignition (HEI) ignition system and FIG. 1B illustrates discharge of the HEI system while

DETAILED DESCRIPTION OF THE PREFERRED EMBODIMENTS

Figure 1A:
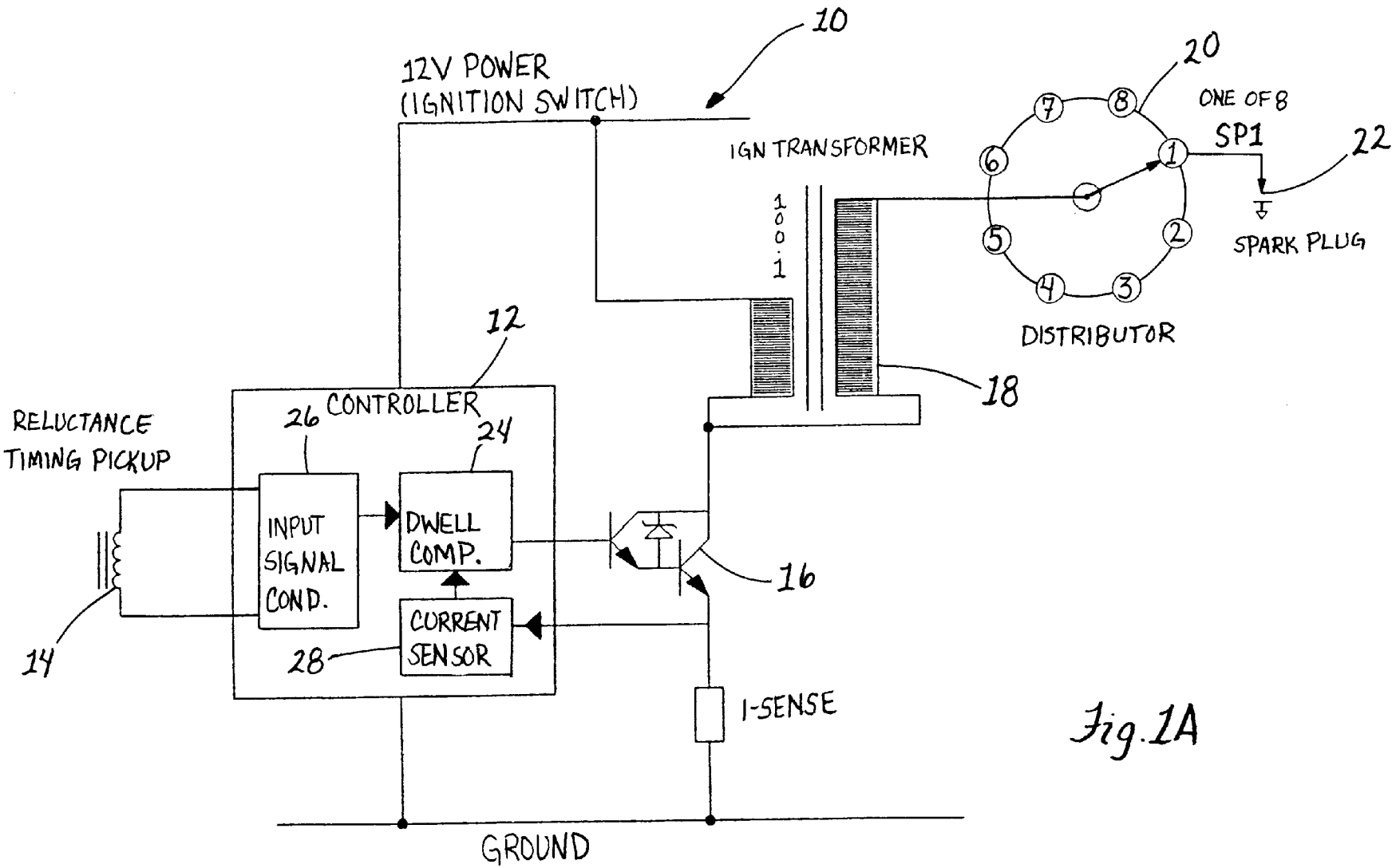
Figure 1B:
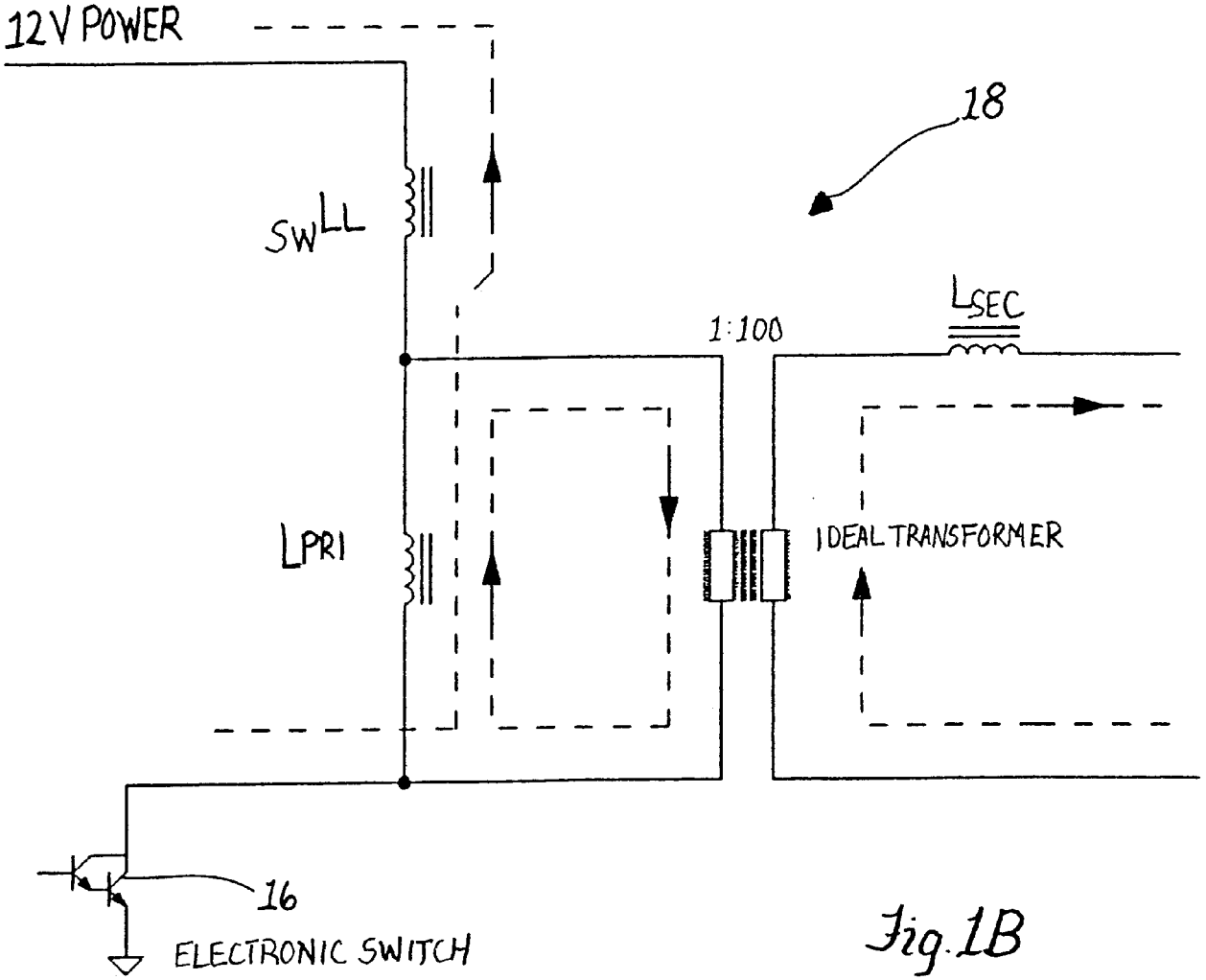
Figure 1C:
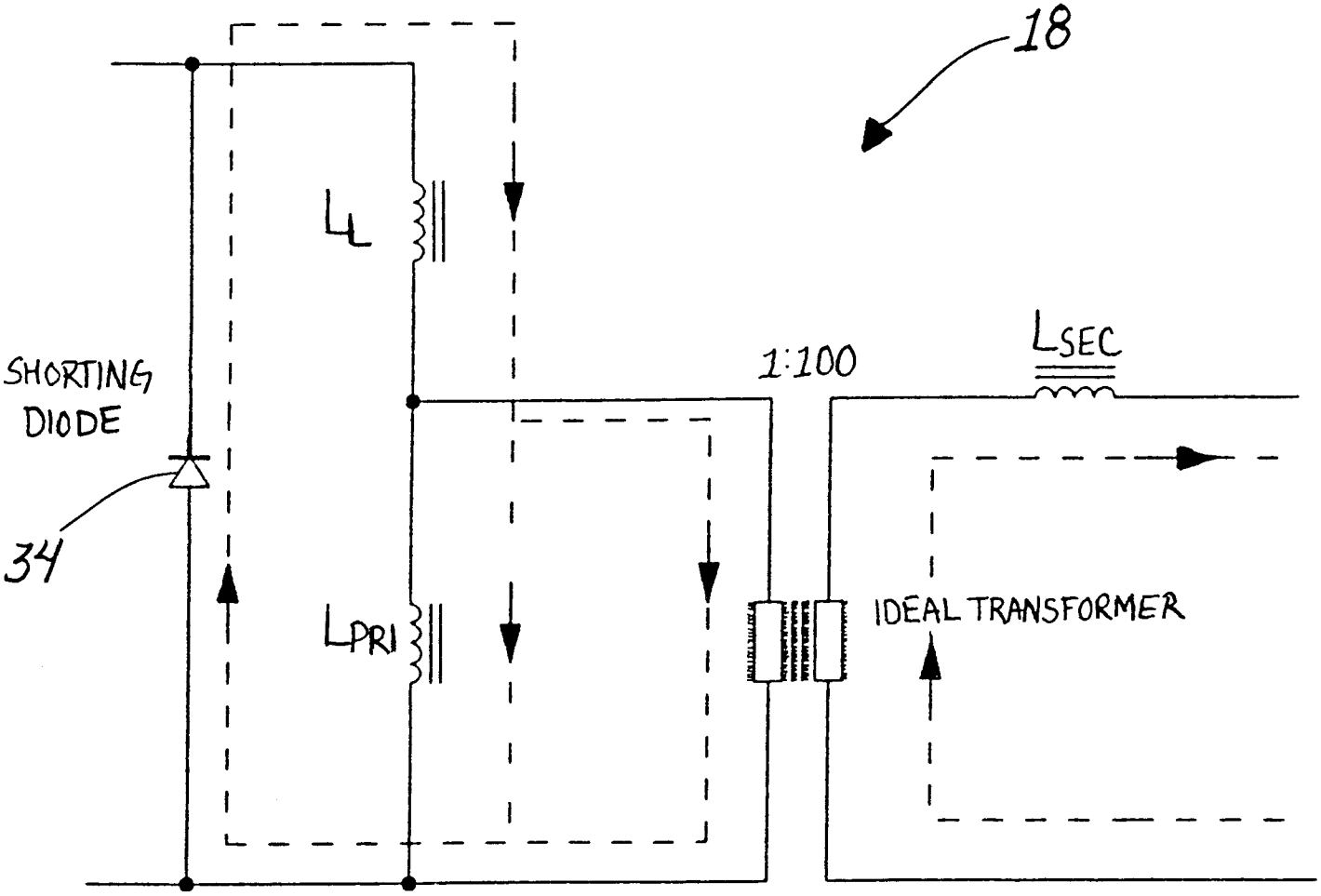
FIG. 1C illustrates the discharge of a Capacitive Discharge (CD) ignition system.
Figures 2, 2A, 2B:
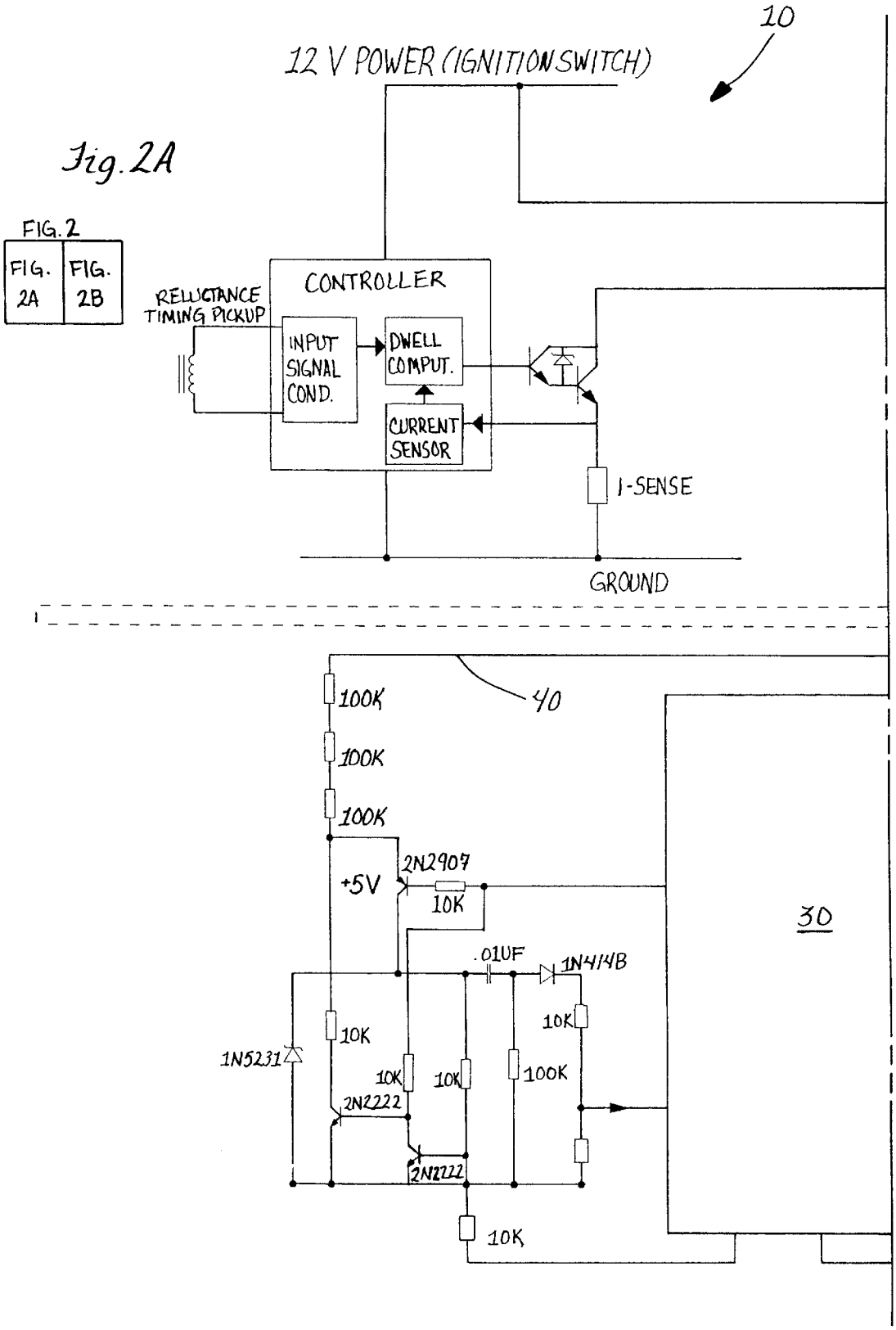
FIG. 2 is a schematic diagram showing an embodiment of the stacker ignition system.
Figure 2B:
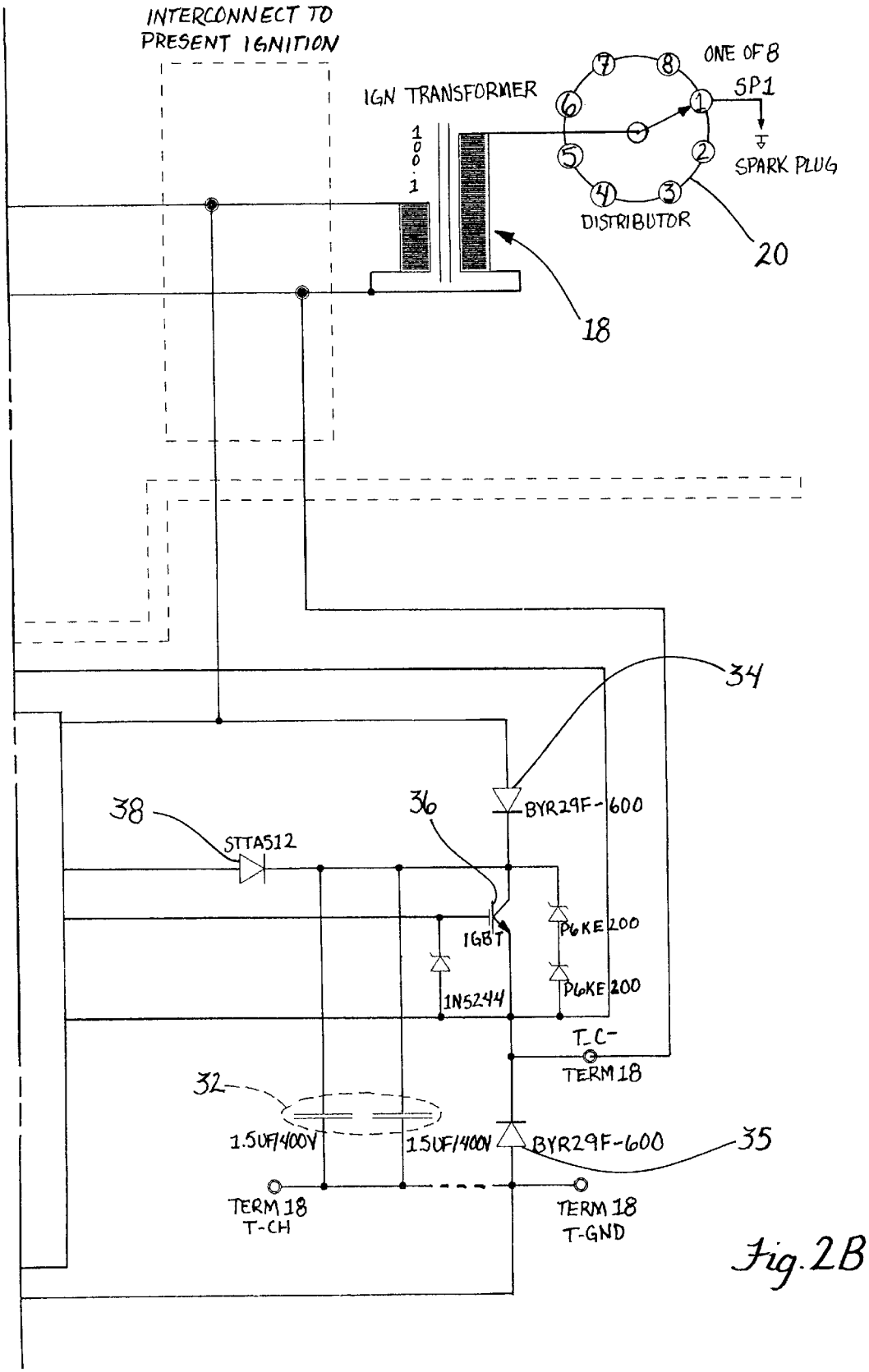

With reference to FIGS. 1A–1C and 2, a high energy ignition (HEI) system 10 is shown in FIG. 1, and the HEI ignition is shown in FIG. 2 with a stacker ignition system as discussed herein, in which a capacitive discharge (CD) ignition system is provided as being stacked upon the conventional HEI system of FIG. 1. As shown in FIG. 2, the stacker ignition system 30 discussed below to provide the capacitive discharge ignition apparatus for use with the conventional ignition of the internal combustion engine having an ignition transformer connected in a circuit for providing a current through a primary coil, the interruption of which generates an ignition voltage across a secondary coil of the ignition transformer for generating a high energy spark producing potential. As shown in the embodiment of FIG. 2, the conventional ignition system and the stacker ignition share a common ignition transformer, however, as discussed further below, while certain economies may be achieved with the common ignition transformer 18, certain of the discussed embodiments may necessitate the use of multiple ignition transformers.

As shown in FIG. 1A, the HEI system 10 includes an electronic controller 12 and timing signals are received via a reluctance timing pick-up 14 responsive to the crankshaft of the engine. The electronic controller 12 controls a Darlington-pair transistor switch 16 for actively controlling the maximum current flowing through the primary coil of the ignition transformer 18. A distributor 20 thus is used to deliver a high energy potential from the secondary of the ignition transformer 18 to the spark gap 22 of a spark plug. In controlling the switch 16, the electronic controller 12 uses a dwell computer 24 to control the timing in response to the magnetic reluctance timing pick-up input signal which is conditioned at an input signal conditioner 26. A current sensor 18 responsive to the current flowing through the electronic switch 16 as measured across a current sensing resistor also provides input to the dwell computer 24 of the electronic controller 12. The electronic controller 12 is thus responsive to a voltage spike sensing the current change through the primary coil of the ignition transformer 18 for triggering the discharging of an ignition storage capacitance.

As shown, the ignition transformer 18 has a secondary coupled to the distributor 20, using eight (8) settings for controlling one out of eight cylinders of the internal combustion engine. The operation of the HEI system, and particularly the characteristics of the ignition transformer 18 are shown in simplified schematic form in FIG. 1B, in which the ignition transformer is broken down into its equivalent electrical components. As indicated, the ignition transformer 18 includes an ideal transformer having a turns ratio of 100:1 with associated primary inductance (LPRI) and leakage inductance (LL), and the secondary of the ignition transformer 18 includes a secondary inductance (LSEC) at the output of the ideal transformer. The ideal transformer would theoretically have no impedance losses, in the sense that the voltage step-up is provided as per the turns ratio, and accordingly the current steps down as per the turns ratio to efficiently transfer energy from the primary coil to the secondary coil, e.g., typically with a turns ratio of 100:1. The primary inductance represents the main inductance of the transformer, which generates the magnetic field to store the energy subsequently transferred to the secondary winding of the ignition transformer 18. The primary inductance is typically 6 to 8 millihenries.

A leakage inductance is also associated with the ignition transformer 18 relating to the inability of the ignition transformer 18 to transfer all of its energy across the transformer, which is often referred to as a coupling deficiency. The leakage inductance is typically on the order of 0.3 to 1.5 millihenries. Additionally, ignition transformer 18 has a secondary inductance impedance associated with the output side of the transformer. With reference to FIG. 1A, the initial charging phase of the primary of the ignition transformer 18 is performed by closure of the electronic switch 16 which energizes the primary coil of the ignition transformer 18. In the HEI system, the main action of the charging of the primary is provided by storing energy in the primary inductance, and a byproduct also stores energy in the leakage inductance.

With reference to FIG. 1B, the discharging of the primary working phase of the HEI system facilitates the main action discharging of the primary inductance into the ideal transformer and thus distributing a high energy spark producing potential at the secondary of the ignition transformer 18. A byproduct of the charging of the primary of the HEI system however produces energy from the leakage inductance which is dissipated later via the electronic switch 16. At a given current most of the stored energy ends up in the primary inductance and a lesser portion in the leakage inductance, but the leakage inductance nonetheless develops a voltage between the power supply and the open electronic switch 16. The collapsing field generates a high voltage surge which may damage the electronic switch, and thus a built-in voltage clamp is provided for safely conducting the energy to ground to protect the electronic switch 16. Accordingly, the leakage inductance energy is dissipated significantly by the switch 16 and is therefore wasted. Accordingly, the HEI system operation illustrated by the simplified schematics of FIGS. 1A and 1C result in a beneficial portion of the stored energy being stored in the primary inductance of the ignition transformer 18, with energy stored in the leakage inductance providing no operational benefit.

Turning to FIG. 2, the HEI ignition system 10 shown at the upper portion of the schematic drawing is interconnected with a stacker ignition system, herein capacitive discharge controller 30, as indicated by the dashed lines indicating the interconnection to the described HEI ignition system. The capacitive discharge (CD) ignition controller 30 of the stacker ignition system charges a high energy capacitor bank 32, the storage capacitance providing energy storage for delivering a potential to the ignition transformer 18. A diode 34 is used with a switch 36 for discharging the storage energy of the capacitor 32 of 3 $\mu$F into the ignition transformer 18. A diode 38 is provided to permit the charging path through the diode 38 to the storage capacitor 32. As shown, the capacitors 32 are charged to approximately 300 volts, designed so as not to damage the HEI system 10. The IGBT switch 36 connects the plus side of the capacitors 32 to coil minus which starts discharging the capacitors 32 into the ignition transformer 18. The leakage inductance controls the rate at which the current is applied to the ideal transformer. The primary current of the ideal transformer is transformed into a current in the secondary, i.e., the output of the ignition transformer coil 18. As described further below, the capacitor 32 and leakage inductance provide a resonant circuit, with the current rising a quarter of the resonance period to a maximum value of approximately 10 to 40 amperes, i.e., 100 to 400 milliamps at the secondary coil with a 100:1 turns ratio. The diode 34 and the switch 36 continue conducting the current once the storage capacitor 32 is fully discharged. The current in the leakage inductance of the ignition transformer 18 represents the energy transferred from the storage capacitor 32.

The energy now stored in the magnetic field of the leakage inductance is the driving force for the current of the ideal transformer. The magnetic field thus collapses to drive a current equal to the peak current at the end of the energy transfer from the storage capacitance 32. Thus the current from the leakage capacitance facilitates the electromotive force through the loads encountered by the ignition transformer 18. While the leakage inductance and the ideal transformer are providing the working current of the system, a voltage appears across the primary of the ignition transformer 18 representing the reflected electromotive force (EMF) of the secondary coil. The voltage reflected is the sum of all the voltage drops across the secondary circuit, i.e., spark gap, ignition wire, distributor cap and resistance of the secondary, secondary inductance, and any other losses associated with the ignition transformer 18. The primary inductance across which the reflected voltage is applied may effectively cause a current which flows in a direction so as to bypass some of the current intended for the ideal transformer, which represents a loss or parasitic current (parasitic stored energy) in the primary inductance. Under normal conditions such parasitic effects may be somewhat small but the effects become rather significant at high rpm operations. Even after the current in the ignition transformer 18 reaches zero, the described parasitic current is still generated. This current decays very slowly in the primary coil because of the low impedance and high inductance involved, and thus if the ignition was used for a high repetition rate, as would be the case at high RPM, there would be a DC-current buildup which subtracts from the current that is supposed to be transferred to the ideal transformer. Accordingly, the circuit provides an alternative path, e.g., diode path 35, to reset the parasitic primary inductance of the ignition coil allowing the energy built up in the parasitic primary inductance (i.e., wasted energy) to be dissipated.

As discussed, whereas the HEI ignition stores energy in the leakage inductance which is dissipated across the switch 16, the CD ignition system uses the leakage inductance to provide the beneficial portion of the stored energy, with the energy stored in the primary inductance providing no benefit. Accordingly, the stacker ignition system combination as embodied herein uses important aspects of both the HEI and CD systems to provide a high energy ignition system.

Figure 3A:
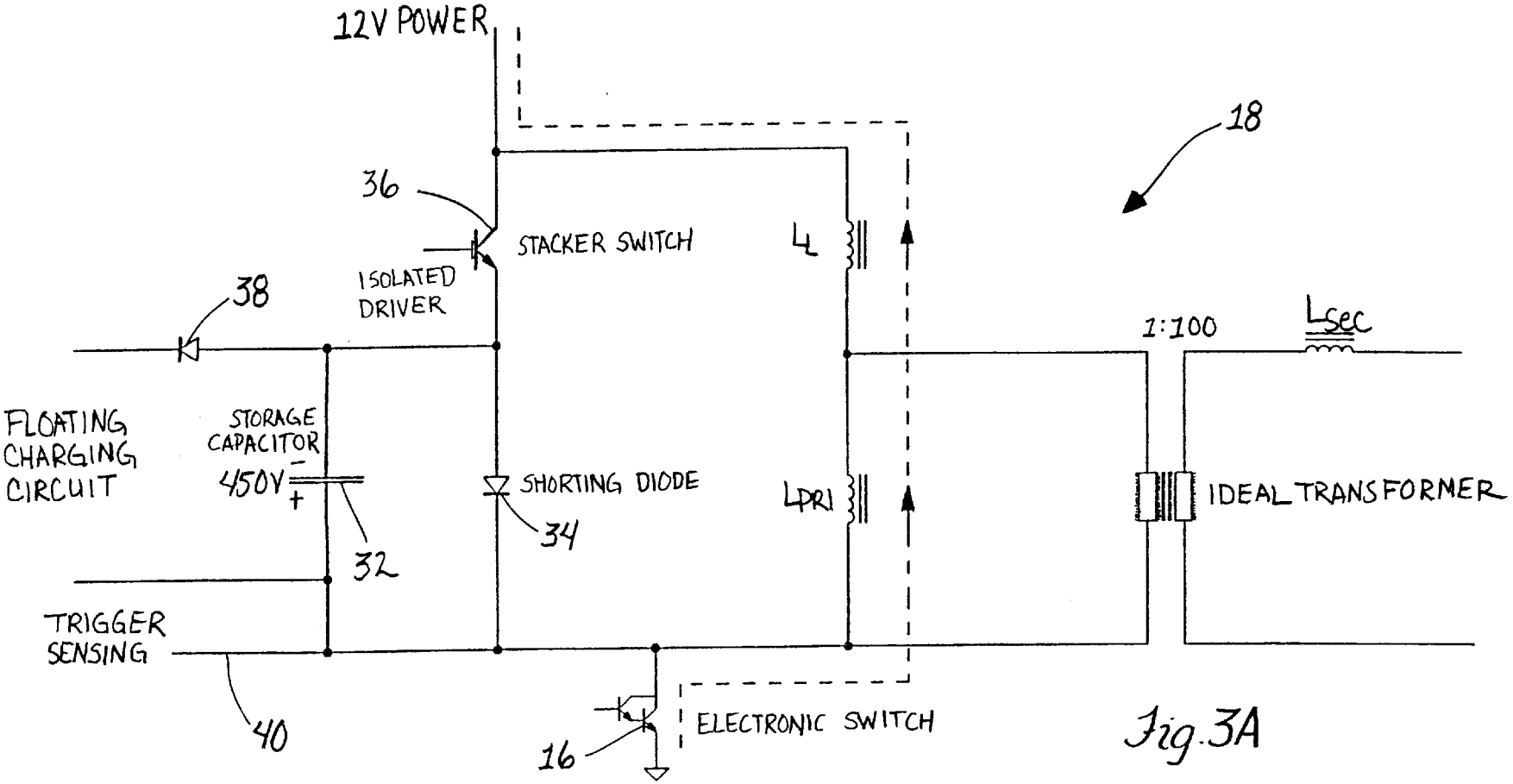
FIGS. 3A–3D illustrate the charging and discharging of the stacker ignition in four phases.

With reference to FIGS. 3A–3D, simplified schematic representations illustrate how it is possible to have both the HEI ignition and the CD ignition create an output through a common ignition transformer coil 18 which creates an output at the secondary of the coil that is the sum of the respective ignition systems. In FIG. 3A, the arrow indicates the direction of current through the coil as the electronic switch 16 of the HEI ignition system 10 is turned on. The current indicated in dashed lines is provided through the coil, i.e., the primary inductance and secondary inductance of the ignition transformer 18 to generate magnetic fields resulting in stored energy in the respective inductive components of the ignition transformer coil 18, i.e., the two components called the leakage inductance and primary inductance discussed above.

Figure 3B:
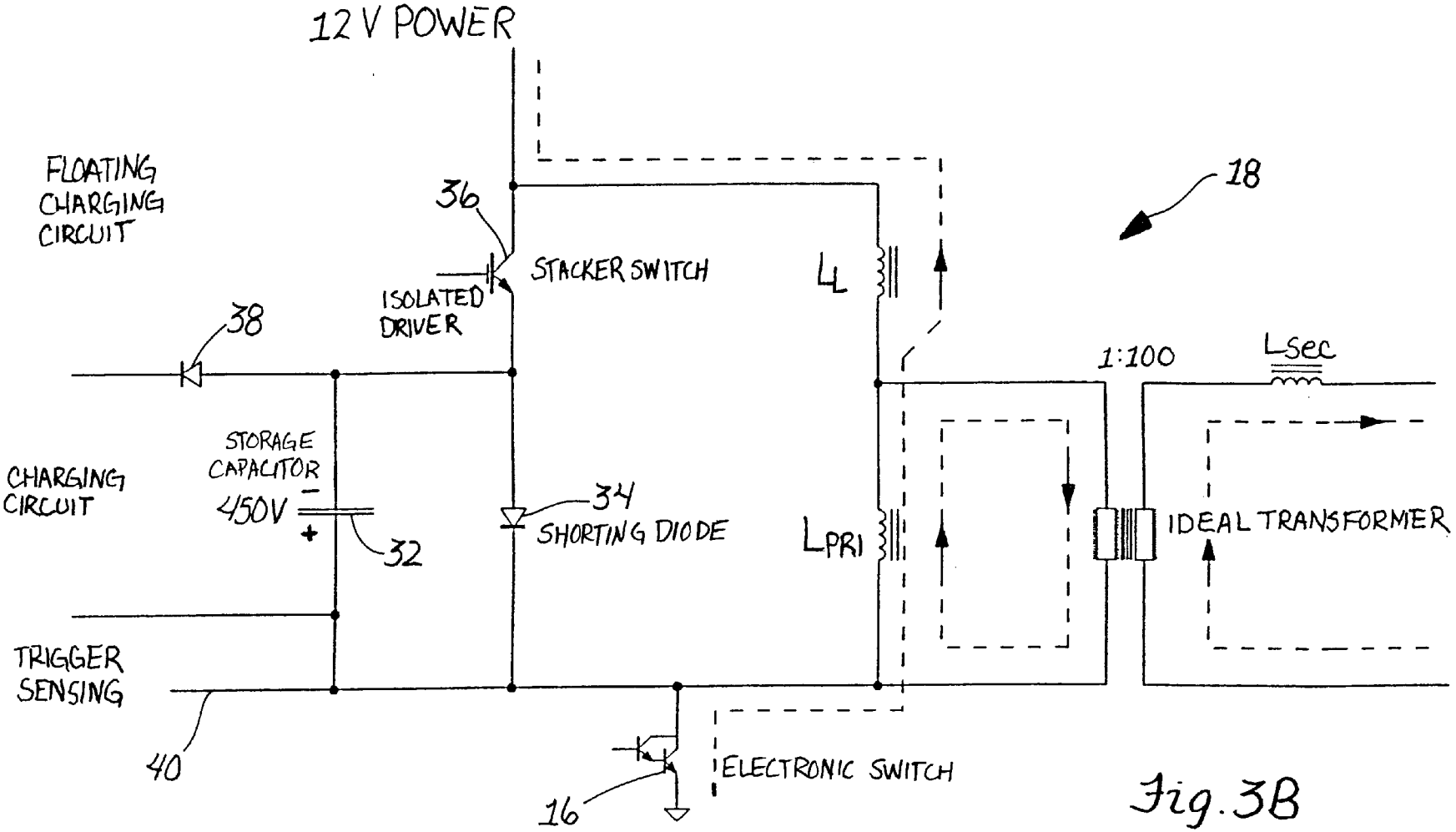
Figure 3C:
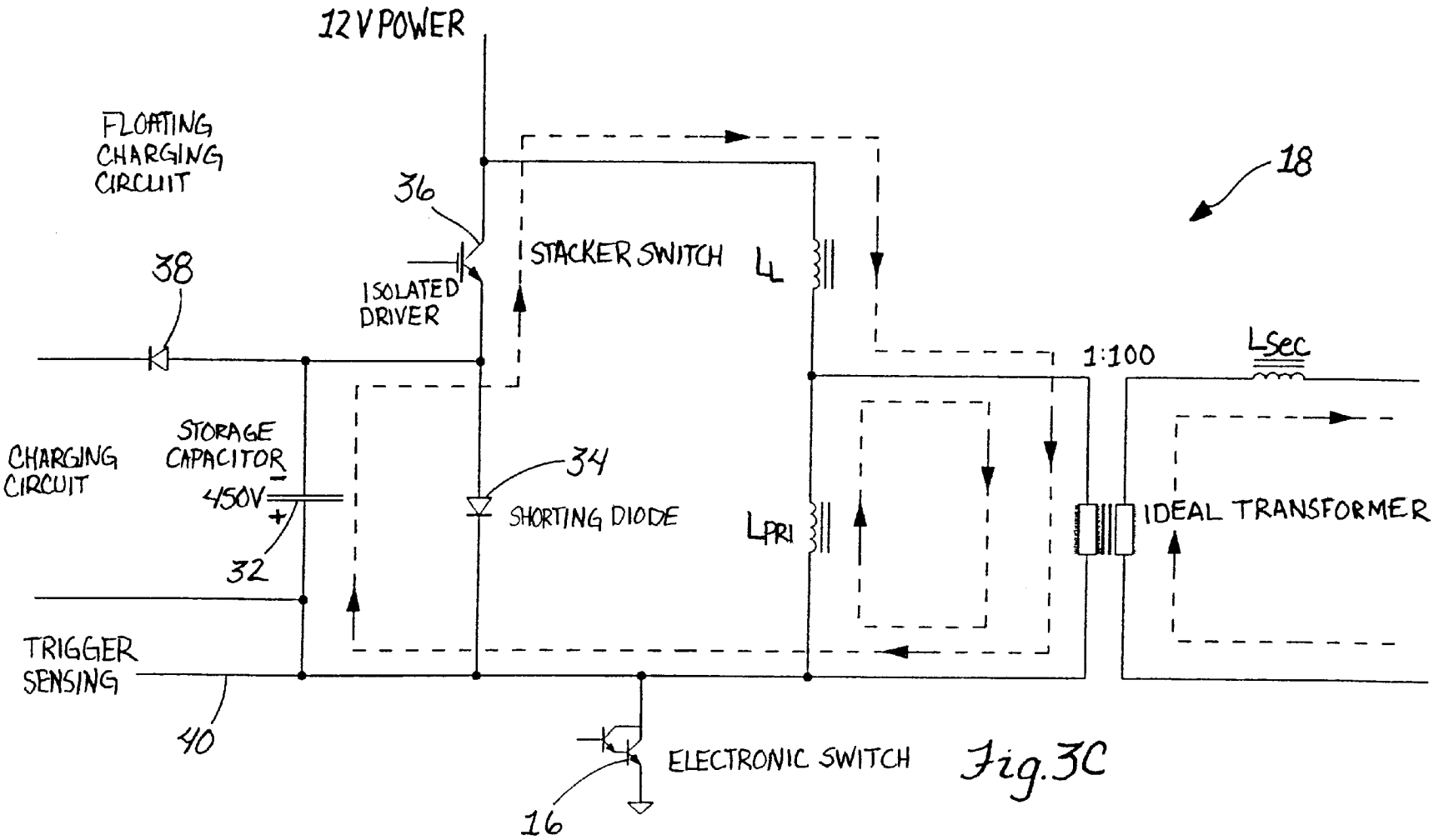

In FIG. 3B, the current that was flowing through the primary inductance of the ignition transformer 18 is redirected into the ideal transformer after the electronic switch 16 of the HEI system 10 is opened. The current in the primary coil of the ideal transformer thus flows from the top of the schematic to the lower portion of the schematic in the primary of the ideal transformer. The energy that was stored in the leakage inductance thus generates a sharp voltage rise across the electronic switch of the HEI system 10 which is absorbed, and provides a trigger signal to the electronic controller 30 of the CD ignition system. With reference to FIG. 3C, the sharp voltage rise in addition to providing a trigger signal, occurs prior to any large voltage generated at the secondary of the ignition coil. Thus the trigger provided by the leakage inductance may be used to signal the stacker ignition electronic switch 36 to close so as to connect the capacitor 32 across the ignition transformer 18. The discharging of the capacitor 32 provides a current which builds through the leakage inductance and joins the current of the primary inductance in flowing through the primary of the ideal transformer. The current rises sinusoidal as seen in a classical resonant circuit.

Figure 3D:
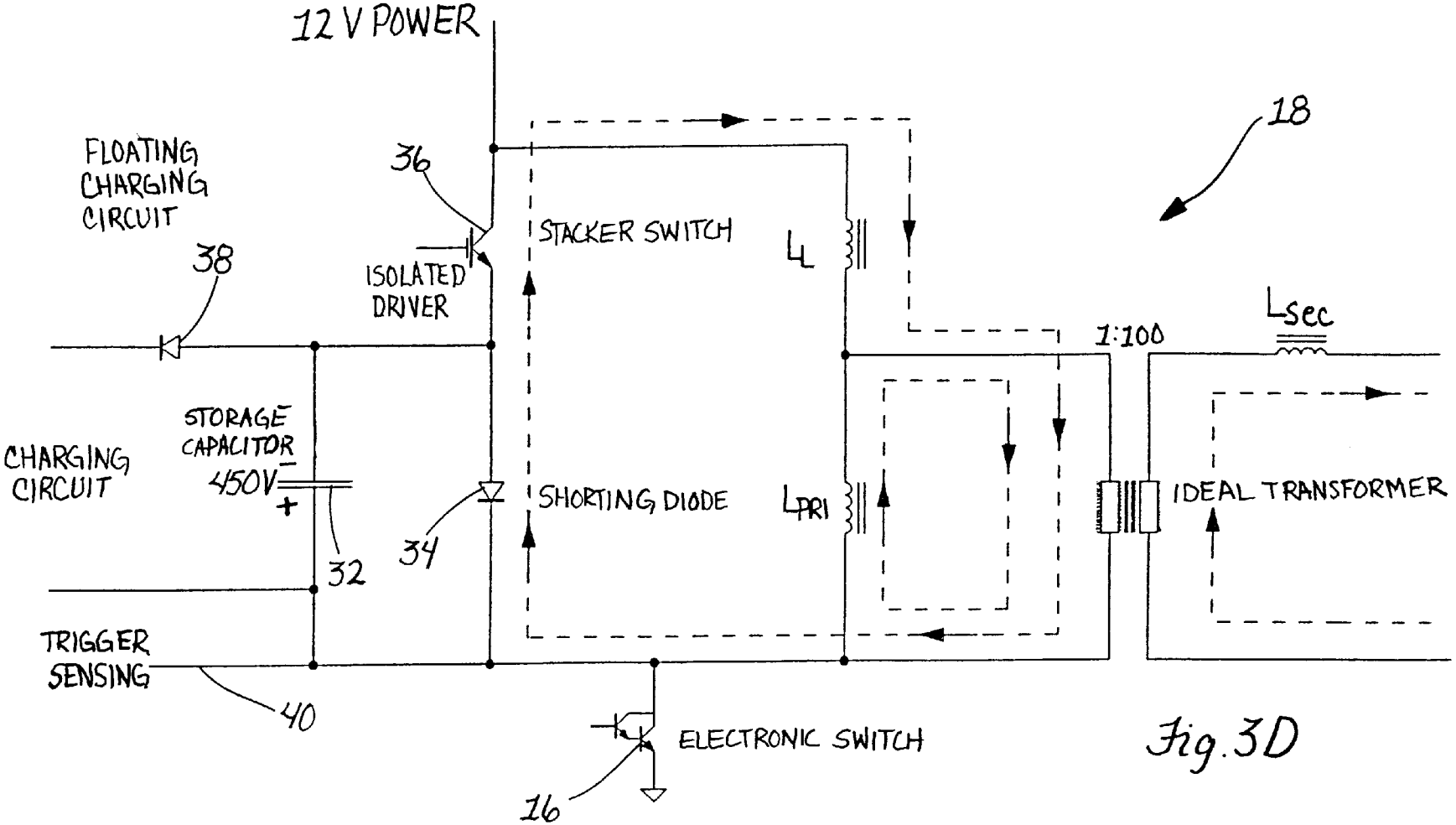

The last and most productive phase of the combined ignition system is shown in FIG. 3D, illustrating the hybrid approach which occurs after the capacitor 32 is fully discharged. As shown, the current of the stacker CD ignition system is then routed through the diode 34. The leakage inductance is the driving force behind the power that is transformed by the ideal transformer to current flow in the output winding of the ignition transformer 18 stemming from the CD ignition of the stacker ignition system. At the same time the energy stored in the primary inductance of the ignition transformer 18 by the HEI system 10 is also delivered to the output of the secondary of the ignition transformer 18.

Figures 4, 4A, 4B:
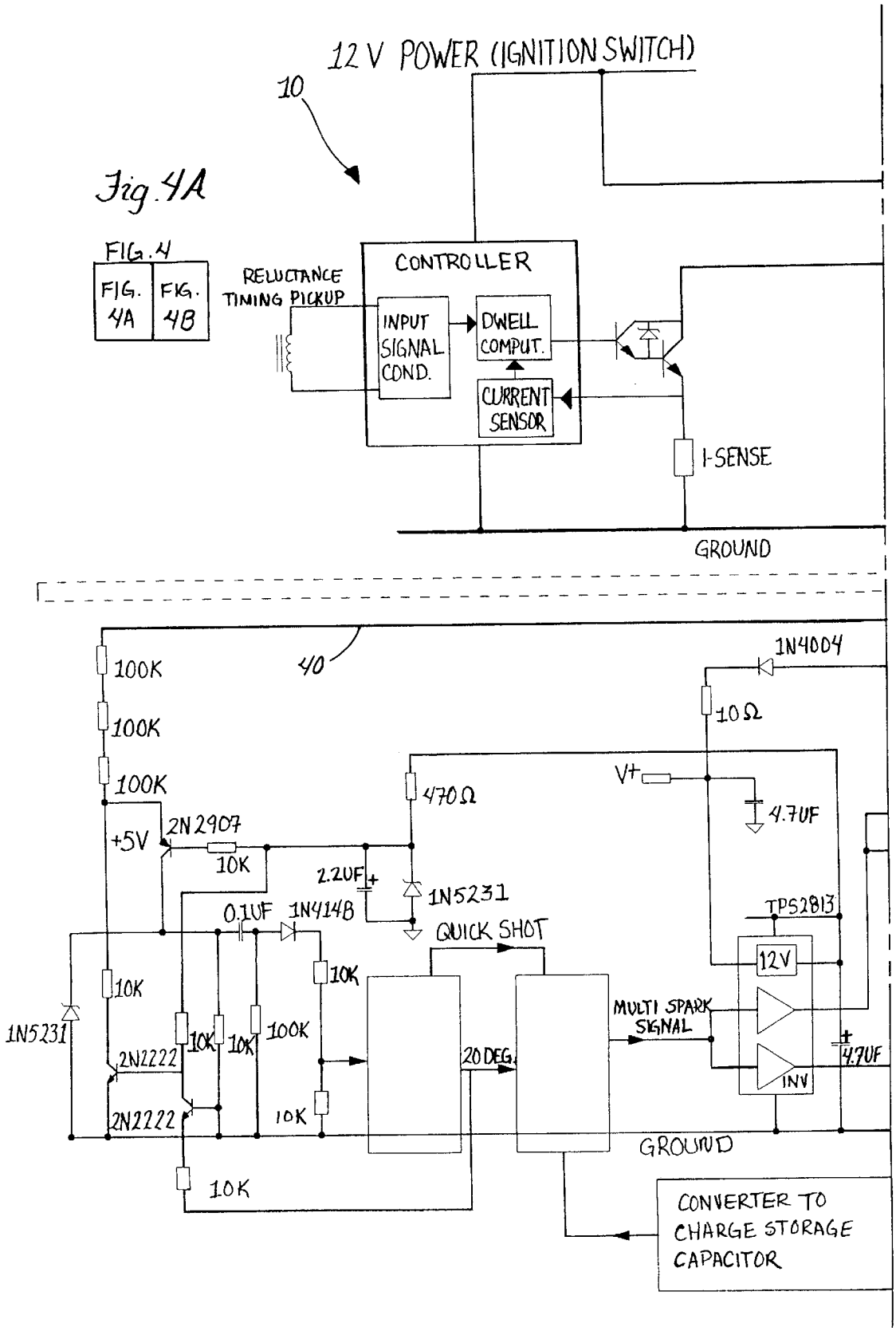
FIG. 4 is a schematic drawing of an embodiment of the invention.
Figure 4B:
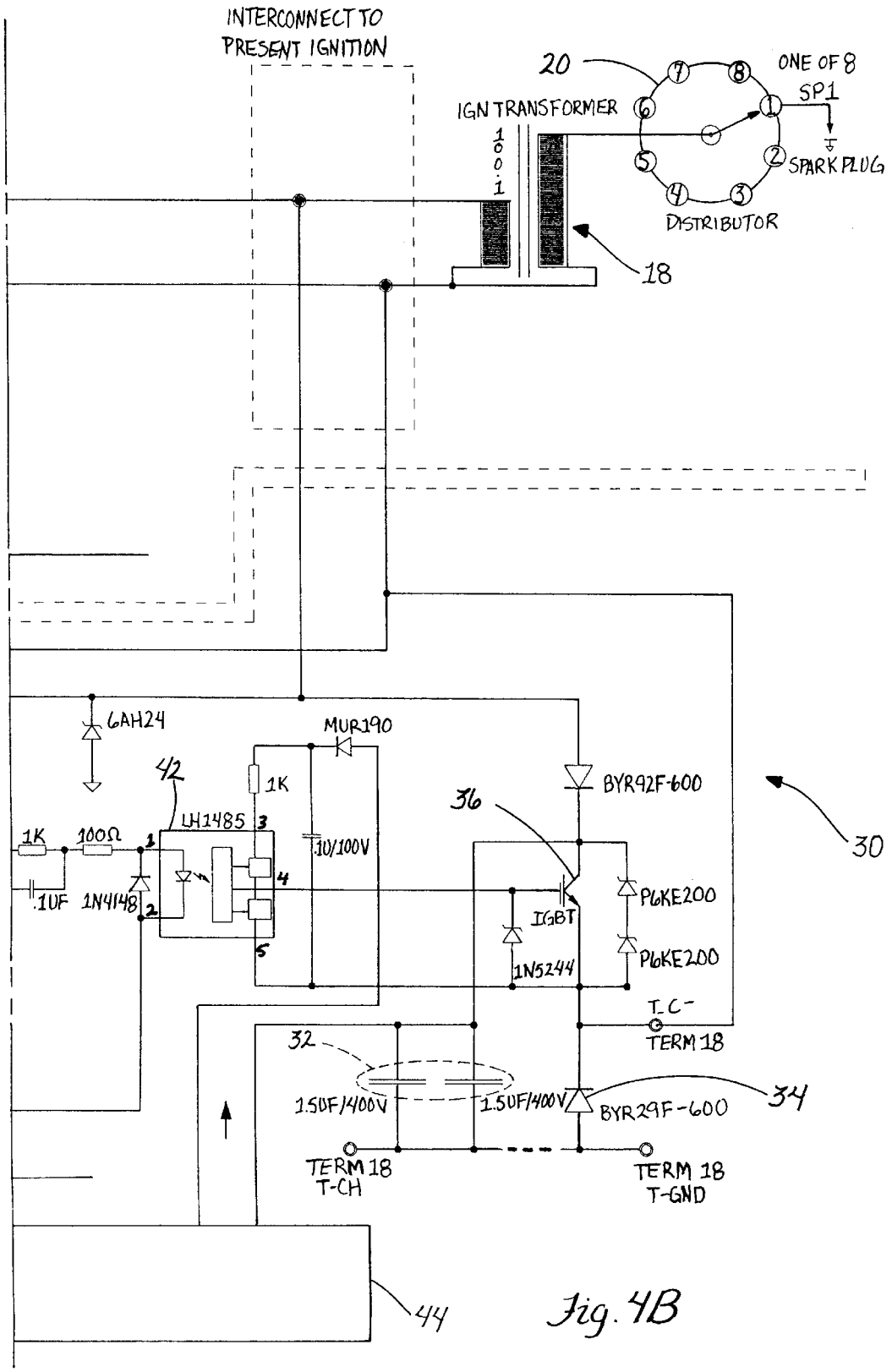

An embodiment of the stacker ignition/CD ignition system directed connected to a conventional HEI ignition system 10 without interruption of, or cutting into, the wires of the stock system is shown in FIG. 4. Herein, the ignition system for use with the internal combustion engine is provided as a capacitive discharge (CD) ignition apparatus 30 for use with the conventional ignition 10 of the internal combustion engine which includes the ignition transformer 18 connected in a circuit for providing a current through a primary coil, the interruption of which generates an ignition voltage across a secondary coil of the transformer 18 as discussed above. The capacitive discharge ignition apparatus includes a wiring assembly as indicated in dashed lines to demark the CD stacker apparatus 30 from the HEI system 10. As shown, the ignition storage capacitor 32 is coupled to the ignition transformer via the wiring assembly, and the apparatus 30 includes a circuit responsive to the current through the primary coil by way of a trigger signal 40 coupled to the wiring assembly. The electronic controller 30 is responsive to a voltage spike sensing the current change through the primary coil of the ignition transformer 18. The discharge switch 36 is coupled with an optical isolator 42 to the timing circuitry of the control circuit 30, with the discharge switch 36 being operable to control the charging of the capacitor 32 from a converter 44, also for triggering the discharging of an ignition storage capacitance providing for the subsequent discharge of the capacitor 32.

Accordingly, the method associated with the described embodiments provide the ignition voltages for use with the internal combustion engine by coupling a capacitive discharge ignition apparatus 30 to the ignition transformer 18 connected in circuit for generating high energy spark producing potentials. Triggering of the capacitive discharge ignition apparatus 30 is provided with signals generated at the ignition transformer 18 of the internal combustion engine. The ignition storage capacitor 32 is then connected via the discharge switch 36 to the ignition transformer 18, and the ignition storage capacitor 32 is thus discharged into the ignition transformer 18 in cooperation with the internal combustion engine ignition system 10.

Figure 5B:
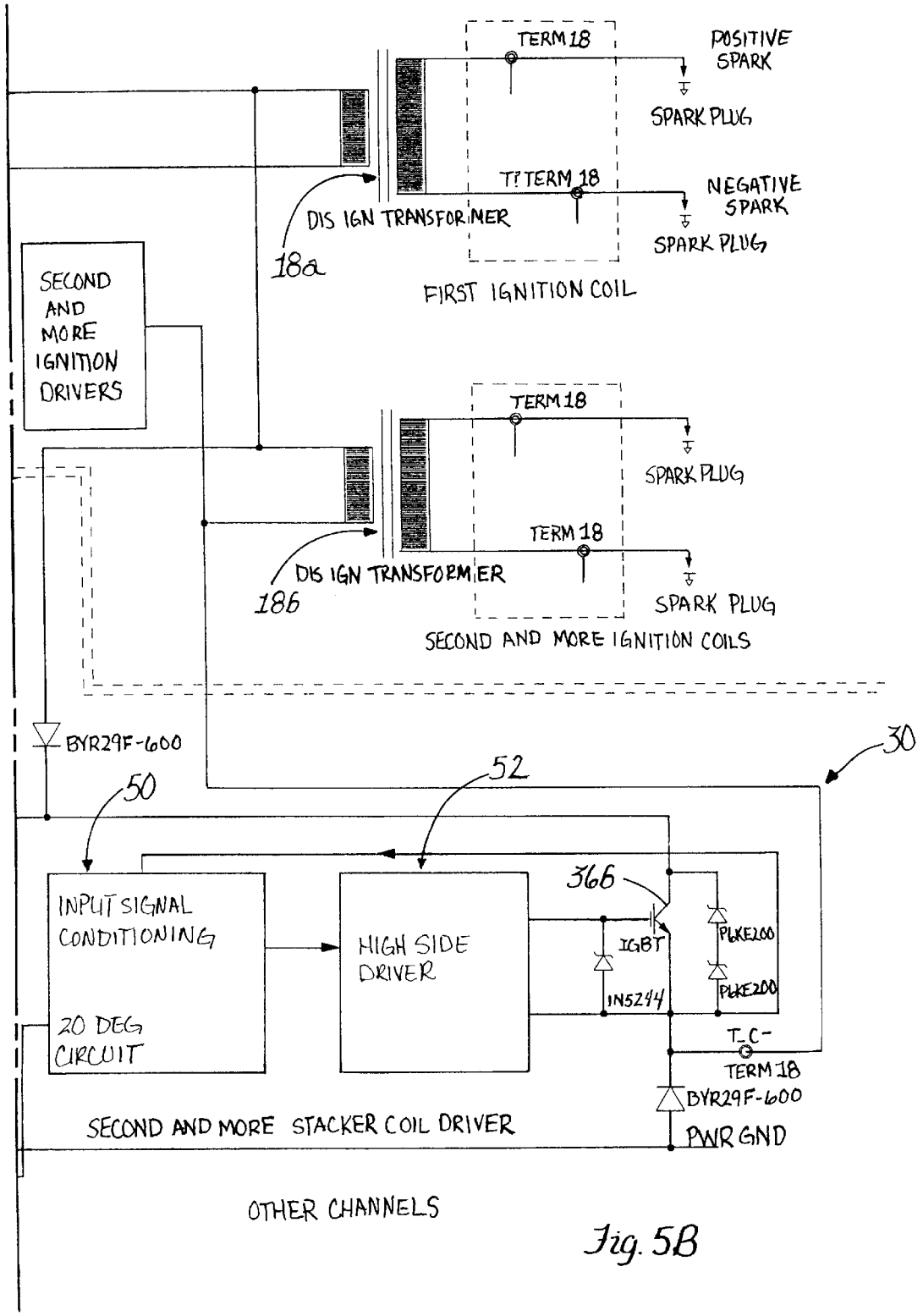
FIG. 5 is a distributorless embodiment of the invention.

With reference to FIG. 5, an implementation of the stacker ignition system 30 is shown directly connected to the HEI ignition system 10 much as the interconnection discussed above in connection with FIG. 4, however, FIG. 5 introduces switches in addition to discharge switch 36 discussed above, i.e., additional high side switches 36*a* and 36*b* which are driven by high side drivers 48 and 52, respectively. The front end of the timing circuitry of the embodiment of FIG. 5 includes input signal conditioning and timing circuits 46 and 50 for respective channels discussed below. The high side switches 36*a* and 36*b* isolate the storage capacitor and the charging circuits from the power switches at the ignition transformers 18*a* and 18*b*, which allows the charging circuitry to begin the recharging of the storage capacitor 32 while the ignition transformers 18*a* and 18*b* are actively generating spark currents. An additional use for the implementation of FIG. 5 is the ability to serve the needs of a distributorless direct fire ignition system (DIS) providing multiple channels of output. Alternatively, a single channel unit may be used with a distributor, the multi-channel embodiments being expandable to as many channels as required for the ignition coils found on the engine.

Figures 6, 6A, 6B:
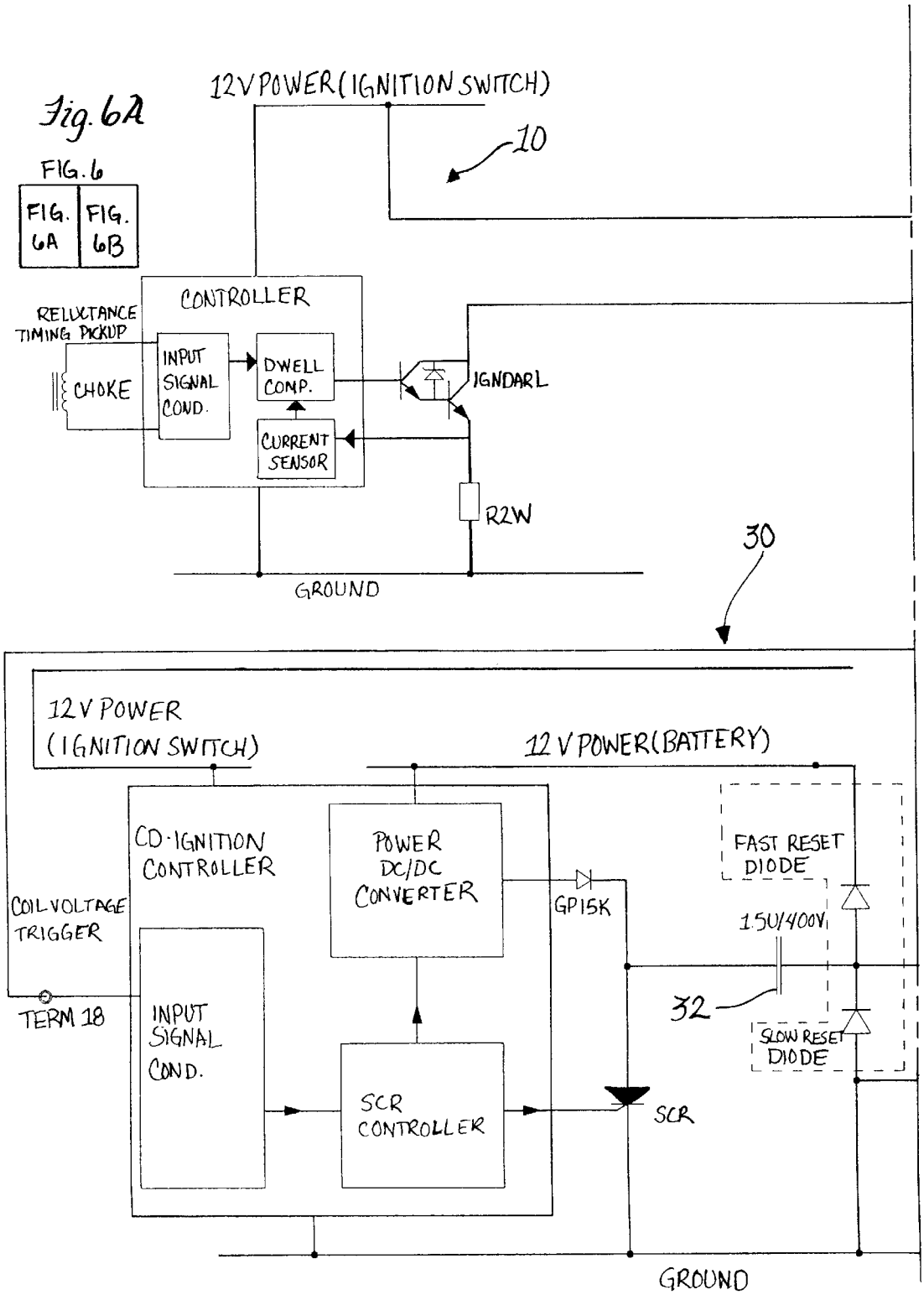
FIG. 6 is another embodiment using a separate transmission transformer.
Figure 6B:
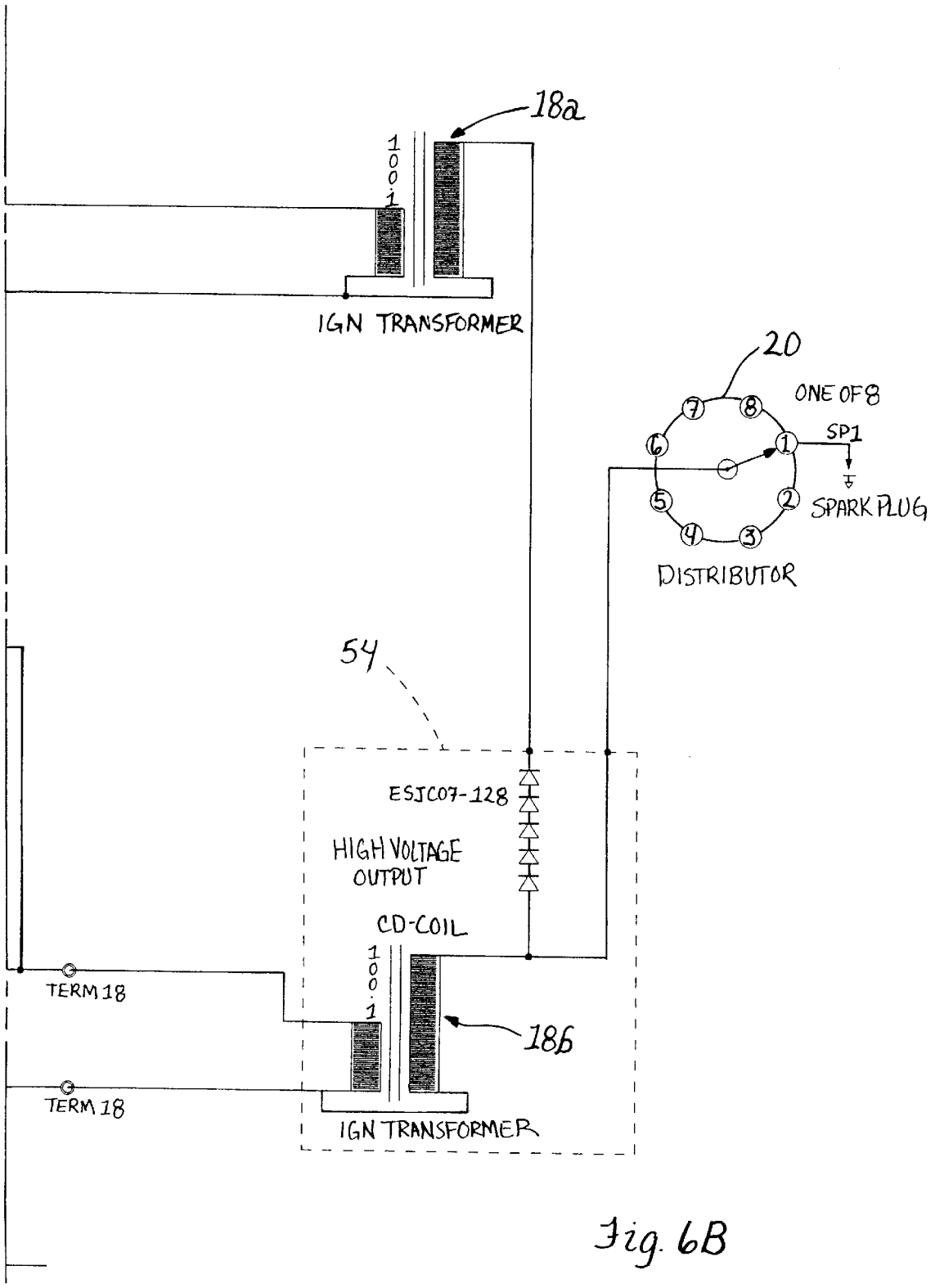

FIG. 6 illustrates an alternative embodiment in which a second ignition transformer 18*b*, in addition to the stock ignition transformer 18*a*, is coupled at the output of the ignition transformer 18*a* in an embodiment which only shares the distributor 20 of the HEI ignition system 10. The embodiment of FIG. 6 may be desirable where it is difficult to obtain access to the wires leading to the primary coil of the stock ignition transformer 18. It should be noted however that the trigger provided by the HEI system 10 to the CD system 30 is still provided by the circuitry via the secondary coils coupled in common with the HEI system 10 which will provide the voltage spike necessary for triggering the timing of the apparatus 30. The solution provided as shown in FIG. 6 bypasses the signal/power-output of the ignition transformer 18*a* through a series of high voltage diodes provided for isolation for the charge cycle of the HEI ignition system 10. At the same time, the negative high voltage created at the beginning of the spark used for the triggering of the CD ignition 30 as discussed above, may be passed on to the trigger coil, i.e., the primary of ignition transformer 18*b*. At the second high voltage terminal of the secondary output of the ignition transformer 18*b*, the two power currents join together as a combined current to flow toward the spark plug.

Figures 7, 7A:
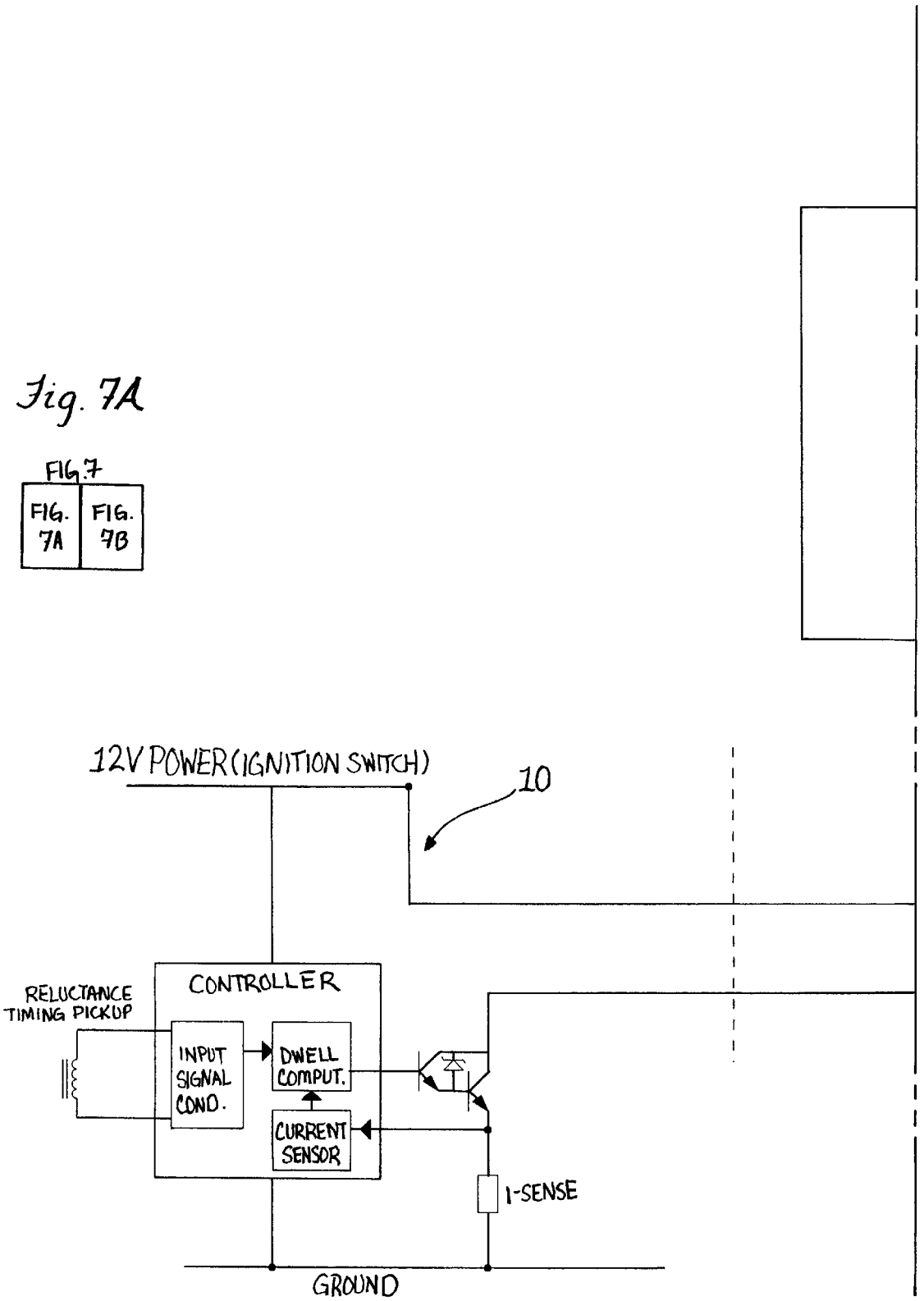
FIG. 7 is an alternate embodiment of the invention.
Figure 7B:
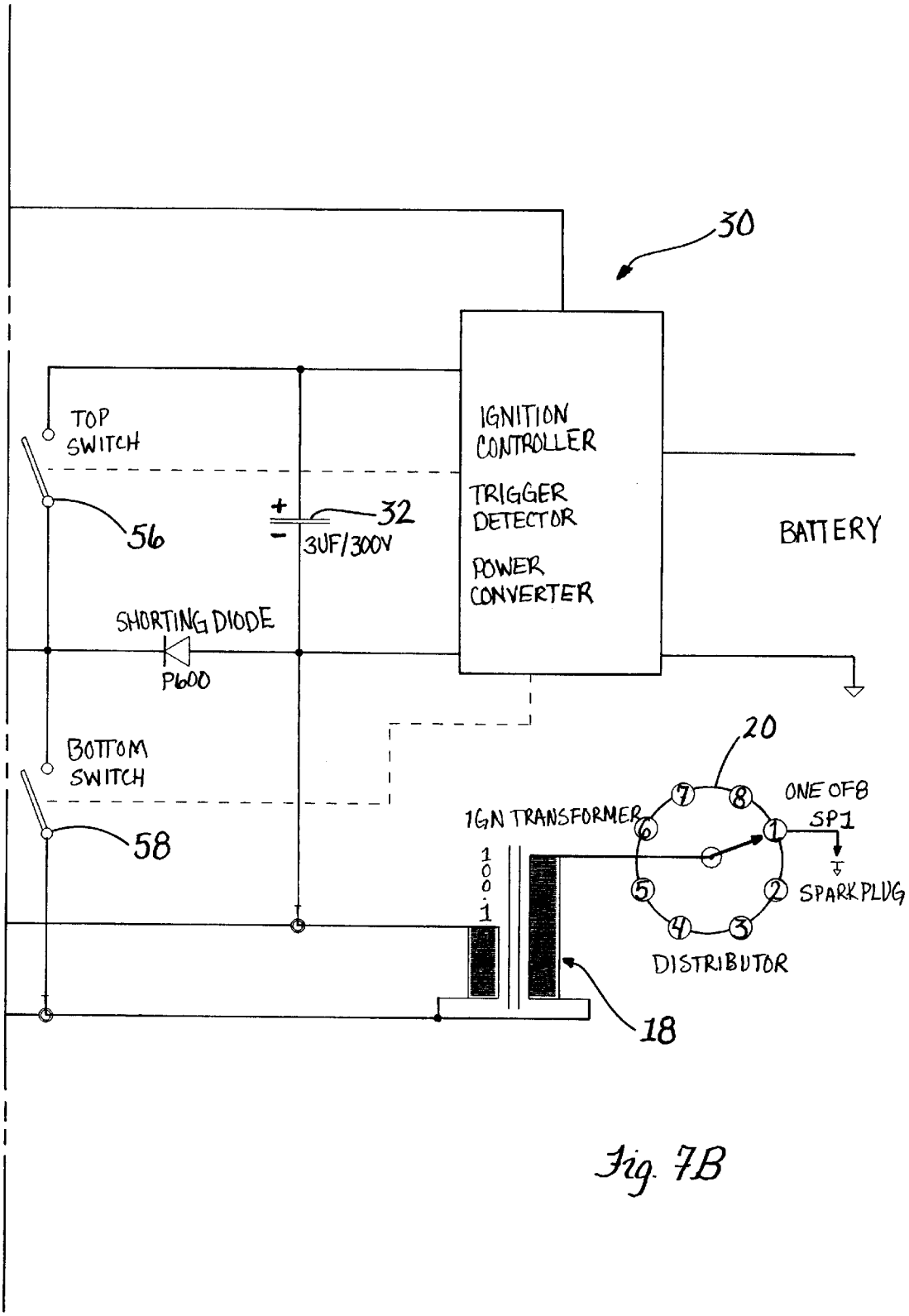

FIG. 7 shows yet another embodiment providing a single channel short form version of FIG. 5 above in which the electronic switches are indicated as mechanical top switch 56 and a bottom switch 58 are provided for extending the spark duration while enabling a quick recharge of the storage capacitor 32. In particular, it should be noted that the switch 56 is used to recharge the capacitor quickly, while the switch 58 provides for the extended spark duration via the ignition transformer 18.

Figure 8A:
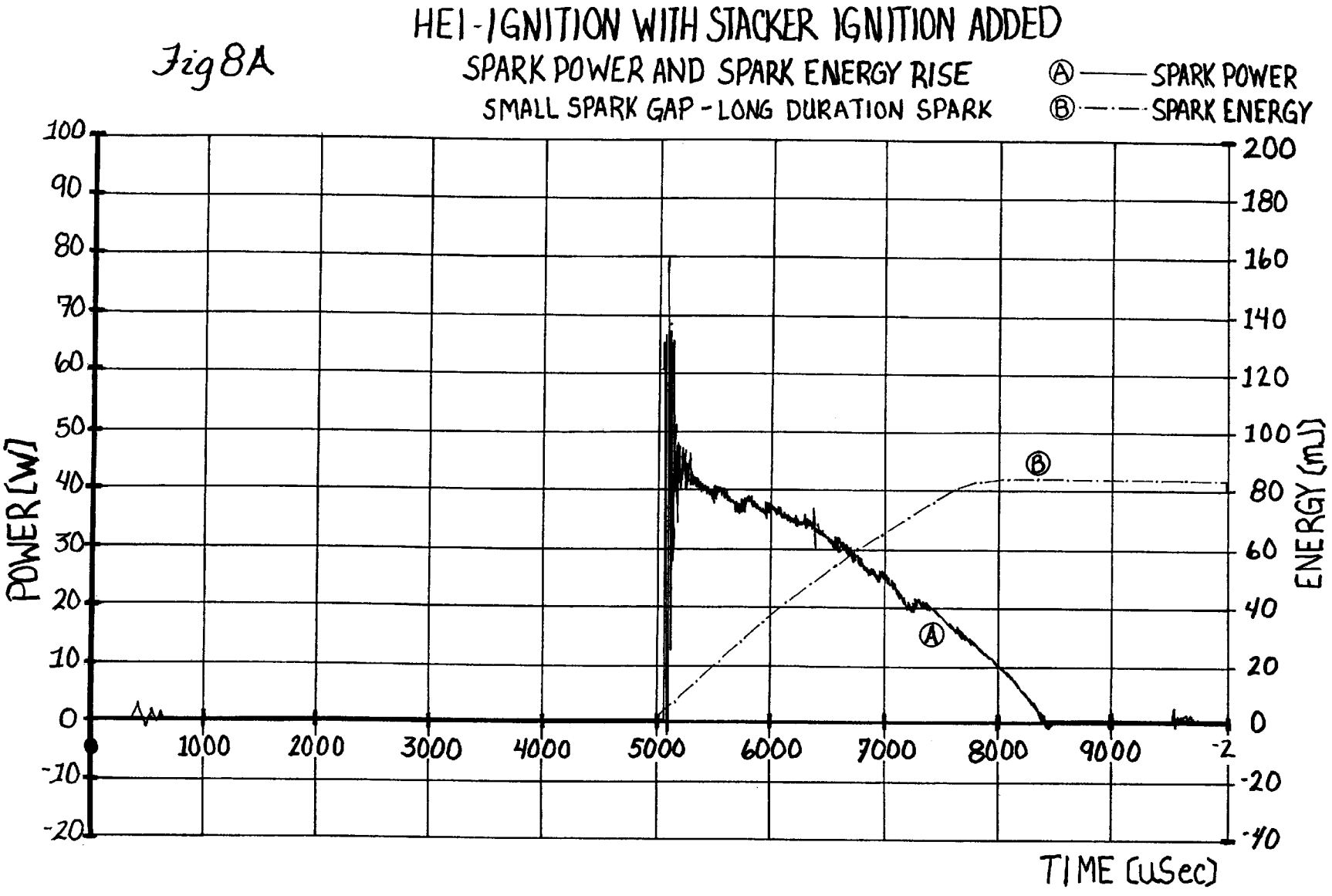
FIGS. 8A–8C graphically show ignition pulse characteristics in accordance with the invention.
Figure 8B:
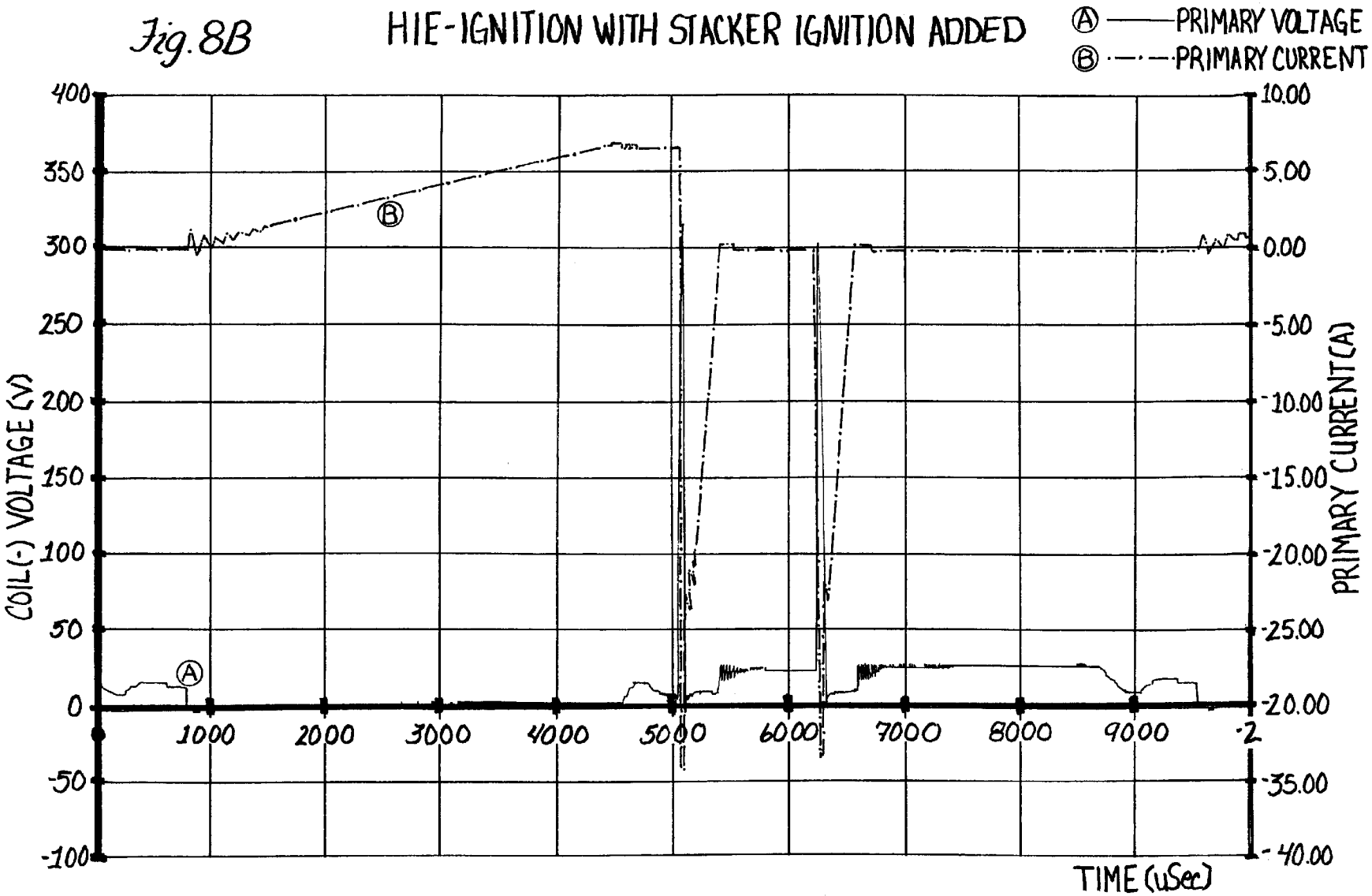
Figure 8C:
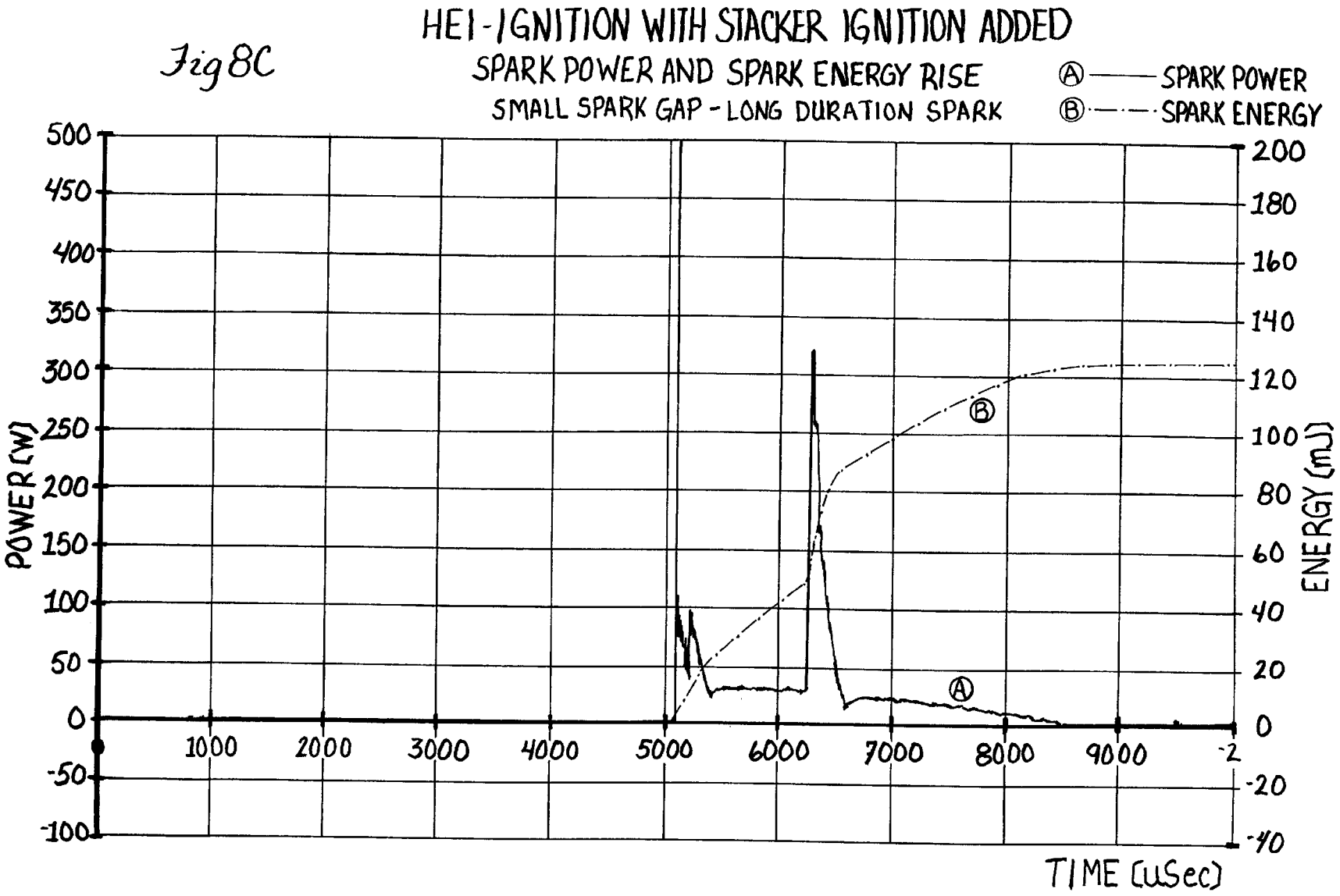

FIGS. 8A, 8B, and 8C show output graphs of the spark power and spark energy of the HEI ignition, the HEI ignition with the stacker ignition added, as shown in FIGS. 8A and 8C respectively. In addition, FIG. 8B shows the primary voltage and primary current of the ignition transformer 18 in the HEI ignition with the stacker ignition being added. As shown in FIG. 8A, the HEI ignition provides high energy spark producing potentials over a period providing an energy level of approximately 80 microjoules. FIG. 8B shows the triggering of the stacker ignition along with the HEI ignition showing primary voltage spikes separated by less than a 1 microsecond. As shown in FIG. 8C, the stacker ignition boosts the energy output to approximately 120 microjoules with an extended spark duration in the illustrated small spark gap, long duration spark being graphically illustrated in the FIGS. 8A–8C.

The above illustrated embodiments describe an electronic ignition system for use with existing ignition circuitry, however, it should be recognized that the principles taught herein may be adapted for use in any ignition system. Each aspect of the system being exemplary, the scope of the invention is not intended to be limited to the specific embodiments shown and described. Instead, the scope of the invention is intended to encompass those modifications and variations which will be apparent to those skilled in the art, the scope being defined by the appended claims.

What is claimed is:

1. An ignition system for use with an internal combustion engine, comprising:

a first controller having a timing pickup input responsive to the crankshaft position of the engine;

an ignition coil;

a current switch connected in a circuit for providing a current flow through said ignition coil, said current switch being coupled to said first controller for controlling the current flow with respect to the crankshaft position;

an ignition storage capacitor coupled to said ignition coil;

a second controller responsive to the current flow through said ignition coil; and a discharge switch connected in a circuit for discharging said storage capacitor into said ignition coil, said discharge switch being coupled to said second controller for controlling the charging and discharging of said storage capacitor.

2. A system as recited in claim 1 wherein said second controller triggers the operation of said discharge switch with respect to the operation of said current switch controlling the current flow through said ignition coil.

3. A system as recited in claim 2 wherein said current switch operation opening the circuit for providing the current flow through said ignition coil generates a sharp voltage rise for triggering said second controller.

4. A system as recited in claim 1 wherein said ignition coil comprises an ignition transformer.

5. An ignition system for use with an internal combustion engine, comprising:

an electronic controller having a timing pickup input responsive to the crankshaft position of the engine;

an ignition coil;

a current switch connected in a circuit for providing a current flow through said ignition coil, said current switch being coupled to said controller for controlling the current flow with respect to the crankshaft position;

an ignition storage capacitor coupled to said ignition coil; and a discharge switch connected in a circuit for discharging said storage capacitor into said ignition coil, said discharge switch being coupled to said controller for controlling the charging and discharging of said storage capacitor with respect to the operation of said current switch.

6. A capacitive discharge ignition apparatus for use with a conventional ignition of an internal combustion engine having an ignition transformer connected in a circuit for providing a current through a primary coil, the interruption of which generates an ignition voltage across a secondary coil of the transformer, the apparatus comprising:

a wiring assembly;

an ignition storage capacitor coupled to the ignition transformer via said wiring assembly;

an electronic controller responsive to the current provided through the primary coil of the ignition transformer of the conventional ignition; and a discharge switch connected in a circuit for discharging said storage capacitor into the ignition transformer, said discharge switch being coupled to said controller for controlling the charging and discharging of said storage capacitor.

7. An apparatus as recited in claim 6 wherein said controller is triggered with respect to the crankshaft position of the engine for discharging said storage capacitor.

8. An apparatus as recited in claim 6 wherein said controller is triggered with respect to the current flow through the primary coil for discharging said capacitor.

9. An apparatus as recited in claim 8 wherein said controller is responsive to the interruption of the current through the primary coil to trigger the operation of said discharge switch.

10. An apparatus as recited in claim 6 wherein said ignition storage capacitor is coupled to the primary coil of the ignition transformer via said wiring assembly.

11. An apparatus as recited in claim 6 comprising a second ignition transformer for generating an ignition voltage, the secondary coils of the respective ignition transformers being coupled to each other for generating a high energy spark producing potential, said ignition storage capacitor being coupled via said second ignition transformer and said wiring assembly.

12. A method of providing ignition voltages for use with an internal combustion engine, comprising:

coupling a capacitive discharge ignition apparatus for use with an internal combustion engine ignition system having an ignition transformer connected in circuit for generating high energy spark producing potentials;

triggering the capacitive discharge ignition apparatus with signals generated at the ignition transformer of the internal combustion engine;

connecting an ignition storage capacitor to the ignition transformer via the capacitive discharge ignition apparatus; and discharging the ignition storage capacitor into the ignition transformer in cooperation with the internal combustion engine ignition system connected to the primary coil of the ignition transformer for generating ignition voltages across the secondary coil of the ignition transformer.

13. A method as recited in claim 12 wherein said coupling step comprises providing a wiring assembly for use with a conventional ignition system of an internal combustion engine, the ignition storage capacitor of the capacitive discharge ignition apparatus being coupled to the ignition transformer via the wiring assembly.

14. A method as recited in claim 12 wherein said triggering step employs an electronic controller responsive to the current through the primary coil of the ignition transformer.

15. A method as recited in claim 14 wherein said electronic controller is responsive to a voltage spike sensing the current change through the primary coil of the ignition transformer for triggering the discharging of the ignition storage capacitor.

16. A method as recited in claim 14 wherein the discharging step uses a discharge switch connected in a circuit for discharging the storage capacitor into the ignition transformer, the discharge switch being coupled to the controller for controlling the charging and discharging of the ignition storage capacitor.

17. A method as recited in claim 12 comprising the step of stacking the capacitive discharge ignition apparatus with a conventional ignition of the internal combustion engine.

* * * * *